United States Patent [19]

Maskasky

[11] 4,094,684

[45] June 13, 1978

[54] PHOTOGRAPHIC EMULSIONS AND ELEMENTS CONTAINING AGEL CRYSTALS FORMING EPITAXIAL JUNCTIONS WITH AGI CRYSTALS

[75] Inventor: Joe E. Maskasky, Rochester, N.Y.

[73] Assignee: Eastman Kodak Company, Rochester, N.Y.

[21] Appl. No.: 770,241

[22] Filed: Feb. 18, 1977

[51] Int. Cl.[2] ..... G03C 1/02; G03C 1/28

[52] U.S. Cl. ..... 96/108; 96/107; 96/100 R; 96/94 R

[58] Field of Search ..... 96/44 R, 108, 100, 107

[56] References Cited

U.S. PATENT DOCUMENTS

| | | | |
|---|---|---|---|
| 3,505,068 | 4/1970 | Beckett et al. | 96/68 |
| 3,804,629 | 4/1974 | Hammerstein et al. | 96/94 R |

FOREIGN PATENT DOCUMENTS

| | | | |
|---|---|---|---|
| 505,102 | 7/1930 | Germany | 96/94 R |
| 1,027,146 | 4/1966 | United Kingdom | 96/94 R |

*Primary Examiner*—Won H. Louie, Jr.
*Attorney, Agent, or Firm*—C. O. Thomas

[57] ABSTRACT

Photographic emulsions and elements are disclosed containing composite silver halide crystals. The composite crystals are comprised of multi-faceted, radiation-receptive silver iodide crystals having a minimum mean diameter of at least 0.1 micron and silver chloride crystals forming epitaxial junctions with the silver iodide crystals. At least half of the facets of the silver iodide crystals are substantially free of epitaxial silver chloride. The silver chlorides are limited to less than 75 mole percent, based on the total silver halide forming the composite crystals.

20 Claims, 5 Drawing Figures

Figure 1:
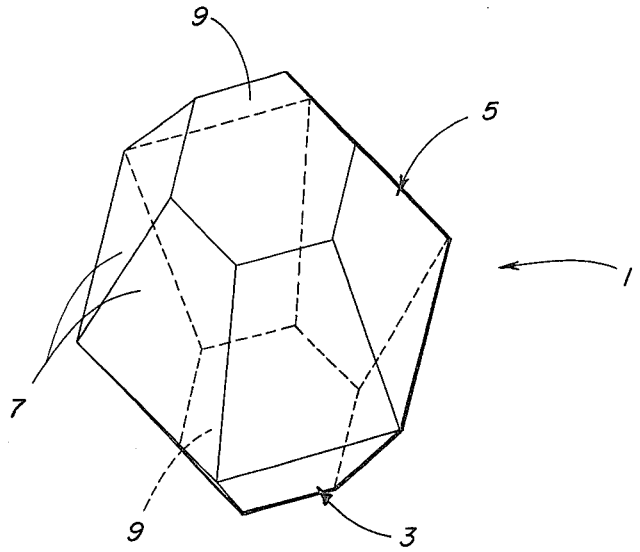

PHOTOGRAPHIC EMULSIONS AND ELEMENTS CONTAINING AGEL CRYSTALS FORMING EPITAXIAL JUNCTIONS WITH AGI CRYSTALS

My invention relates to photographic emulsions and elements. More specifically, my invention relates to photographic emulsions and elements incorporating silver chloride and silver iodide in a composite grain structure.

It is known in photography that silver halide grains are useful in forming developable latent images when struck by actinic radiation, such as electromagnetic radiation, neutrons, beta particles or the like. Many patents refer to the use of silver bromide, silver chloride, silver iodide, silver bromoiodide, silver chloroiodide, silver chlorobromide and silver chlorobromoiodide, reflecting an intent to include all photographically useful silver halides.

Such teachings should not, however, be misconstrued to imply that all silver halides have similar properties or that all possible combinations of these halides are thereby disclosed. In Mees and James, *The Theory of the Photographic Process,* the Macmillan Company, New York, Third Edition, 1966, Chapters 1 and 2 are directed to the properties of silver halides and silver halide grain structures. As these chapters make abundantly clear the physical properties of silver halides differ significantly. Further, the discussion, such as that appearing under the heading "Precipitation of Iodide with Silver Bromide", pp. 34 and 35, further makes apparent that terms such as "silver bromoiodide" are generic in character and in fact encompass an array of variant crystallographic structures.

In considering merely the light absorption characteristics of silver halides one might assume silver iodide emulsions to be most commonly employed in photography, since silver iodide exhibits an absorption peak at about 420 nm while silver chloride and silver bromide both exhibit absorption peaks in the ultraviolet region of the spectrum and only toe absorptions within the visible spectrum. As a matter of fact, pure silver iodide emulsions have found very limited photographic utility. One theory that has been advanced to account for the limited utility of silver iodide emulsions is that, while photons striking silver iodide crystals form hole-electron pairs, the recombination of the hole-electron pairs occurs more readily than in silver bromide and silver chloride. Thus, in the absence of special techniques, little, if any, developable latent image is retained in the light exposed silver iodide grains.

Most commonly, silver iodide has been employed in proportions of less than about 10 percent by weight in photographic emulsions containing silver bromoiodide or silver chlorobromoidide grains. Such silver halide emulsions have been found to be readily developable and capable of attaining high photographic speeds.

Pure silver chloride emulsions have been employed in photography for a variety of applications. While a number of specific applications have been found especially suited for silver chloride emulsions, one particularly desirable attribute is their relatively high development rate. In this regard, it should be noted that silver chloride has a solubility product constant which is approximately six orders of magnitude larger than that of silver iodide and three orders of magnitude larger than that of silver bromide. However, as against other silver halides, silver chloride suffers the limitation of having the least native sensitivity to the visible region of the spectrum, the spectral sensitivity of silver chloride to wavelengths longer than about 290 nm being substantially diminished.

The concept of combining halides to achieve the advantages of separate silver halides within a single silver halide grain structure has been recognized in the art. Klein et al. British Pat. No. 1,027,146 discloses a technique for forming composite silver halide grains. Klein et al. forms silver halide core or nuclei grains and then proceeds to cover them with one or more contiguous layers of silver halide. The composite silver halide grains contain silver chloride, silver bromide, silver iodide or mixtures thereof. For example, a core of silver bromide can be coated with a layer of silver chloride or a mixture of silver bromide and silver iodide, or a core of silver chloride can have deposited thereon a layer of silver bromide. In depositing silver chloride on silver bromide Klein et al. teaches obtaining the spectral response of silver bromide and the developability characteristics of silver chloride.

Beckett et al. U.S. Pat. No. 3,505,068, issued Apr. 7, 1970, uses the techniques taught by Klein et al. to prepare a slow emulsion layer to be employed in combination with a faster emulsion layer to achieve lower contrast for a dye image. The silver halide grains employed in the slow emulsion layer have a core of silver iodide or silver haloiodide and a shell which is free of iodide composed of, for example, silver bromide, silver chloride or silver chlorobromide.

Steigman German Pat. No. 505,012, issued Aug. 12, 1930, teaches forming silver halide emulsions which upon development have a green tone. This is achieved by precipitating silver halide under conditions wherein potassium iodide and sodium chloride are introduced in succession. Examination of emulsions made by this process indicates that very small silver iodide grains, substantially less than 0.1 micron in mean diameter, are formed. Further, separate silver chloride grains are formed. Increasing the silver iodide grain size results in a conversion of the desired green tone to a brown tone. An essentially cumulative teaching by Steigman appears in *Photographic Industrie,* "Green- and Brown-Developing Emulsions," Vol. 34, pp. 764, 766 and 872, published July 8 and Aug. 5, 1938.

Levy U.S. Pat. No. 3,656,962, issued Apr. 18, 1972, and U.S. Pat. Nos. 3,852,066 and 3,852,067, issued Dec. 1974, teach the incorporation of inorganic crystalline materials into silver halide emulsions. It is stated that the intimate physical association of the silver halide grains and the inorganic crystals can alter the sensitivity of the silver halide emulsion to light.

My photographic emulsions and elements employ a novel composite silver halide crystal structure which combines the radiation-response of silver iodide with the ready developability of silver chloride. As an illustration, I have discovered that, when composite silver halide grains according to my invention are coated in an emulsion layer, exposed to radiation within the portion of the visible spectrum where silver iodide is capable of absorption, but silver chloride exhibits little absorption, and developed under conditions which permit development of light-struck silver chloride grains, I am able to produce photographic images. I accomplish this even though similarly prepared, exposed and processed photographic elements having emulsions of silver iodide, silver chloride, or a mixture of silver iodide and silver chloride grains fail to produce photographic images or produce comparatively low density or low speed photographic images.

I have further found a way of achieving this desirable combination of silver iodide and silver chloride properties using a limited amount of silver chloride. More specifically, I have avoided any necessity of shelling silver iodide grains with silver chloride. Thus, I have avoided the very large chloride to iodide ratios which would be required in attempting to shell silver iodide grains with silver chloride of dissimilar crystal habit. I have found further that by minimizing the silver chloride to silver iodide ratios required in composite grains, I am able to achieve higher speed to silver ratios than heretofore possible with shelled grain structures. Still further, I am able to achieve photographic speeds which are comparable to those of silver bromoiodide emulsions.

My photographic emulsions and elements are capable of liberating relatively large quantities of iodide ion upon development, and I am thereby able most advantageously to achieve photographic effects dependent on iodide ion release. Specifically, I have found that the photographic emulsions and elements of my invention exhibit highly favorable interimage and edge effects. I can also employ the iodide ions released during development to poison heterogeneous catalyst surfaces, such as those employed in redox amplification reactions of oxidizing agents, e.g. cobalt hexammine or hydrogen peroxide, and dye image generating reducting agents, e.g. color developing agents and redox dye-releasers (employed in combination with electron transfer agents).

An additional advantage of my invention is that my photographic elements and emulsions can be developed to produce a heterogeneous catalyst image—i.e. a silver image—for use in a redox amplification reaction. This is particularly surprising, since, under modified conditions, I can employ the iodide ions released during development to poison the silver image as a redox amplification catalyst.

A still further advantage of my invention is in obtaining photographic images, both silver and dye images, of reduced graininess and granularity. More specifically image graininess and granularity characteristics can be attained which are characteristic of much smaller grain sizes and much slower emulsions than those I employ.

In still an additional aspect of my invention, I provide photographic emulsions which can be selectively developed so that silver chloride is developed or so that both silver chloride and silver iodide are developed. In this way I can select development conditions to control the graininess and granularity of photographic images, control iodide ion release and control maximum image densities obtained.

In one aspect, my invention is directed to a photographic emulsion comprised of a photographic vehicle as a continuous phase and, as a discrete phase, radiation-sensitive composite silver halide crystals. The composite crystals are comprised of a multi-faceted, radiation-receptive silver iodide crystals having a minimum mean diameter of at least 0.1 micron. Silver chloride crystals form an epitaxial junction with the silver iodide crystals. Silver chloride is limited to less than 75 mole percent, based on total silver halide forming the discrete phase, and at least half of the facets of the silver iodide crystals are substantially free of epitaxial silver chloride.

In another aspect my invention is directed to an improvement in a photographic element having a support and, coated on the support, a radiation-sensitive layer including radiation-sensitive silver halide crystals. At least a portion of the radiation-sensitive silver halide crystals are composite silver halide crystals comprised of multi-faceted, radiation-receptive silver iodide crystals having a minimum mean diameter of at least 0.1 micron. Silver chloride crystals form epitaxial junctions with the silver iodide crystals, and at least half of the facets of the silver iodide crystals are substantially free of epitaxial silver chloride. The silver chloride of the composite crystals is limited to less than 75 mole percent, based on the total silver halide forming the composite crystals.

My invention may be more fully appreciated by reference to the following detailed description considered in conjunction with the drawings, in which FIGS. 1 through 4 are illustrations of silver halide crystals. The crystals are depicted substantially enlarged to facilitate viewing.

Figure 5:
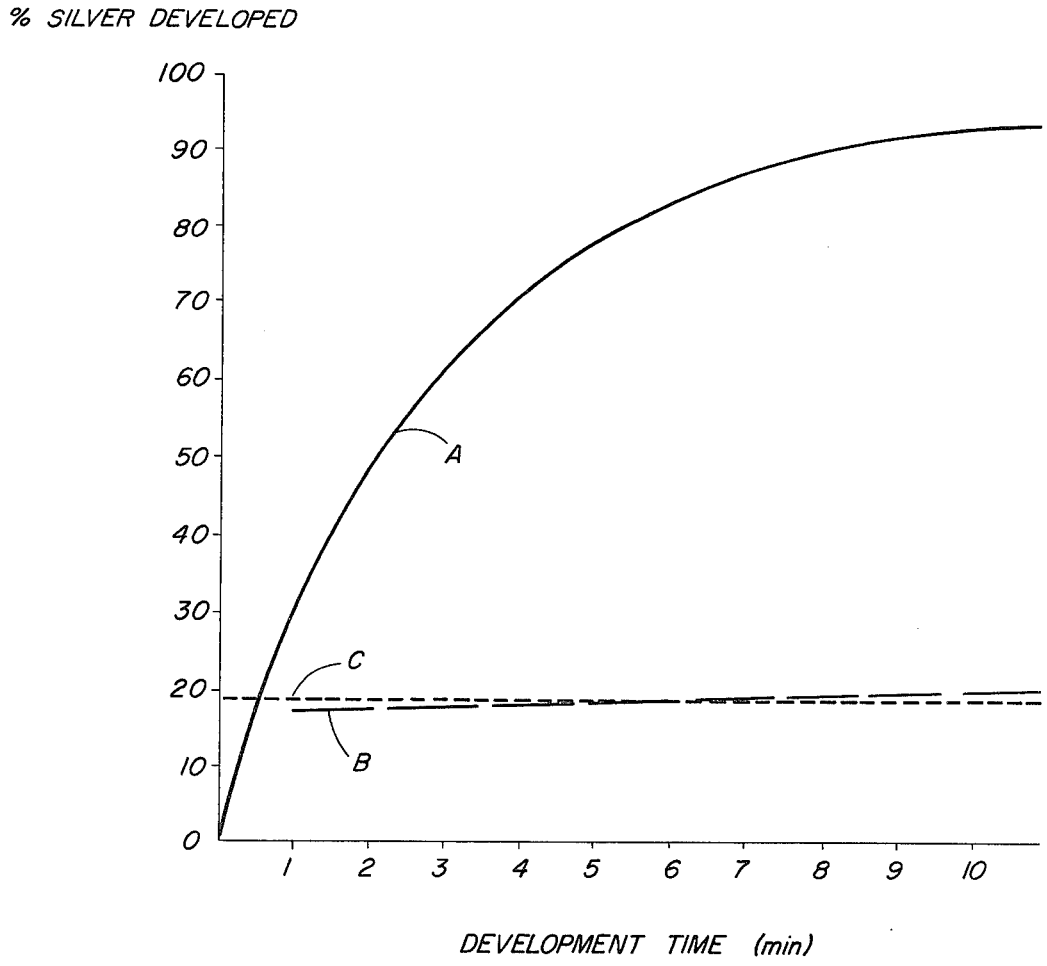

FIG. 5 is a plot of development time in minutes against the percentage of silver developed.

The photographic emulsions employed in the practice of my invention contain composite crystals of silver iodide and silver chloride. One portion of each composite crystal is a conventional silver iodide crystal. In a common, preferred form the silver iodide crystal is a beta-phase silver iodide crystal (a hexagonal structure of wurtzite type). Such crystals are truncated hexagonal bipyramids. A regulated truncated hexagonal bipyramid 1 is shown in FIG. 1. As is apparent from the figure, the crystal can be resolved into two fused truncated hexagonal pyramids 3 and 5 sharing a common base. Each truncated pyramid then presents externally six lateral facets 7 and a truncating facet 9. Most commonly silver iodide emulsions contain beta-phase silver iodide crystals or mixtures of beta-phase silver iodide crystals with minor proportions of gamma-phase silver iodide crystals (face-centered cubic structures of zincblende type).

Figure 2:
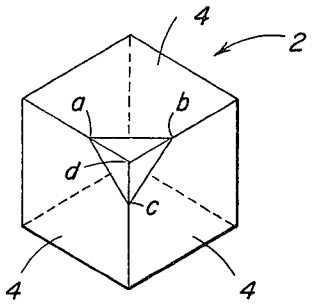

A second portion of each composite crystal is a cubic silver chloride crystal. A cubic silver chloride crystal 2 is shown in FIG. 2. The cubic crystal presents six quadrilateral crystal facets 4. The points *a, b* and *c* lying on intersecting edges of the cubic crystal define a triangular plane intersecting the cube. The intersecting plane is a 111 crystal plane. All of the points *a, b* and *c* are equidistant from the point of intersection *d* of the converging edges on which points *a, b* and *c* lie.

Figure 3:
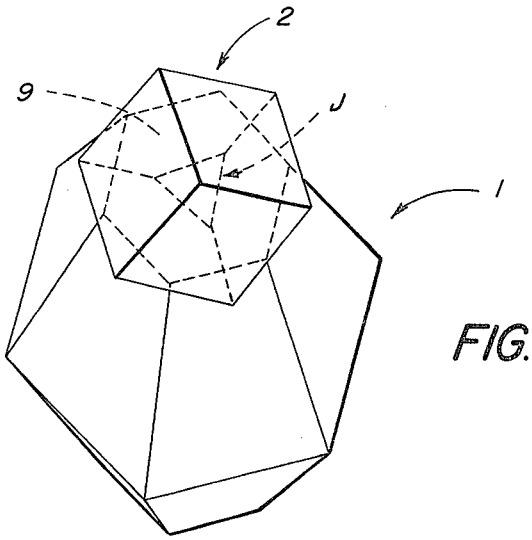

A typical composite crystal configuration present in the emulsions of my invention is shown in FIG. 3. The composite crystal is comprised of a truncated hexagonal bipyramid beta-phase silver iodide crystal 1 with which a cubic silver chloride crystal 2 forms an epitaxial junction J. The junction is formed by a truncating facet 9 of the silver iodide crystal, which forms a 001 crystal plane of the silver iodide crystal. The spacing of iodide and silver atoms in a 001 plane approximates (within about 16 percent) the spacing of silver and chloride atoms in the 111 crystal plane of the cubic silver chloride crystal. I believe this explains the observed epitaxial growth of a cubic silver chloride crystal at the truncating facet 9 of the silver iodide crystal.

In viewing photomicrographs of the grains of my emulsions the composite structure shown in FIG. 3 appears quite common, usually predominant. A common variation, which may be predominant, is for a second silver chloride cubic crystal to be similarly associated with the remaining truncating facet 9 of the silver iodide crystal.

Figure 4:
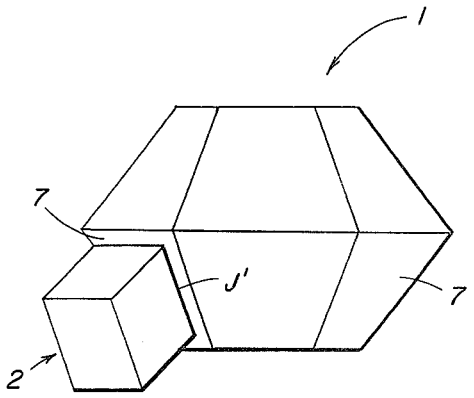

In FIG. 4 another variant form the composite crystals according to my invention is shown. In this figure the truncated hexagonal bipyramid silver iodide crystal 1 forms an epitaxial junction J' with a cubic silver chloride crystal 2. In this instance the junction is formed by one of the crystal facets 4 of the cubic silver chloride crystal and one of the lateral facets 7 of the silver iodide crystal. This crystal configuration accounts for only a minor proportion of the composite crystals present and is believed to represent a less crystallographically favored epitaxial arrangement of the silver iodide and silver chloride crystals. In photomicrographs of my emulsions I have observed silver chloride crystals to be epitaxially associated with both a truncating facet and a lateral facet of a single silver iodide grain, particularly where a high ratio of chloride to iodide is employed. Generally my emulsions as initially prepared can contain a mixture of all of the above mentioned variant structural forms of the composite crystals of silver chloride and silver iodide.

When blue light, for example, strikes an emulsion containing the composite crystals according to my invention, a developable latent image is formed. Since silver chloride is known to exhibit a very limited absorption of blue light as compared to silver iodide, the latent image must be attributed to the photons striking the silver iodide crystal. In fact, the wedge spectrogram produced by the composite crystals matches that of silver iodide.

It is accepted that absorbed photons generate latent images by generating hole-electron pairs. In silver iodide crystals lacking epitaxially joined silver chloride grains the hole-electron pairs do not result in a developable latent image being formed unless the silver iodide is modified in some way. This is believed to be the result of hole-electron pair recombinations occurring within the silver iodide crystal. I have observed that the exposure of the silver iodide and silver chloride composite crystals in my emulsions can result in rendering the entire composite silver halide crystal developable or only the silver chloride portion.

From the above discussion it is apparent that it is the silver iodide crystal portion of the composite crystal which acts as the primary radiation receptor. In order to achieve acceptable photographic speeds employing the composite crystals for imaging purposes I contemplate that the mean diameter of the silver iodide crystals within the composite crystals will in all instances be at least 0.1 micron, preferably at least 0.2 micron. The maximum mean diameter of the silver iodide crystals can be as large as the largest silver halide grains conventionally employed in photography. For example, I contemplate using very large silver iodide crystals, up to about 4 microns in mean diameter, as is practiced in high speed radiographic applications. Still larger diameter crystals can be employed, although image definition will be necessarily less precise.

While it has previously been taught in the art to form composite silver halide grains by forming a shell over a core crystal structure, it is a significant feature of my invention that the silver chloride crystal does not form a shell on a silver iodide crystal with which it is epitaxially fused. At least half of the surface areas of the silver iodide crystals are free of epitaxial silver chloride, and epitaxial silver chloride is typically limited to one, two or, occasionally, three facets of the silver iodide crystals. When the silver chloride reaches 75 mole percent of the total silver halide, encroachment of the silver chloride crystal structure on the surfaces of the silver iodide crystal facets adjacent the crystal facet of the silver iodide at which epitaxial growth of silver chloride commenced can be observed. However, no shell is in evidence.

As is apparent from the above discussion, the epitaxial silver chloride crystals are not the primary radiation receptors of the composite crystals. Hence the speed of the emulsions is not controlled by the radiation striking the epitaxial silver chloride crystals. Viewed in a slightly different way, it is apparent that increasing the epitaxial silver chloride in proportion to the silver iodide can actually decrease the speed to silver halide ratio of an emulsion, rendering it less efficient in comparison to other emulsions of similar silver halide content. I attribute the high photographic speeds attainable by my emulsions, as compared to emulsions of conventional core-shell silver halide grains, to the specific combination of silver halides and to the limited proportion of silver chloride crystals making up the composite crystals.

Generally the composite silver halide grains employed in my emulsions contain less than 75 mole percent silver chloride. (Unless otherwise stated, all epitaxial silver chloride mole percentages are based on total silver halide of the composite crystals.) This is a much lower proportion of silver chloride than would be required to shell the silver iodide grain 1. I generally prefer that the proportion of epitaxial silver chloride in the composite grains be less than 50 mole percent.

The minimum amount of epitaxial silver chloride employed is only that required to assure its distribution among the host silver iodide crystals. Generally developable emulsions can be obtained with as little as 1 mole percent silver chloride. I generally prefer that the epitaxial silver chloride grains account for at least 5 mole percent of the composite crystals, since silver chloride has the effect of accelerating initial development rates. The optimum proportion of silver chloride is dependent, of course, upon the specific application contemplated. Where high radiation exposure levels are contemplated and rapid developability is being sought, a somewhat higher proportion of epitaxial silver chloride can be efficiently employed than where low radiation exposure levels and less rapid development requirements are contemplated.

A specific advantage of limiting the size of the epitaxial silver chloride crystals in the composite silver halide crystals is achieved when development conditions are controlled so that the epitaxial silver chloride crystals, but not the host silver iodide crystals, are developed. In this instance the image graininess and granularity is determined by the limited diameters of the epitaxial silver chloride crystals (in the absence of solution physical development), even though their photographic speed is determined by the much larger host silver iodide crystals. For example, when composite silver chloride and silver iodide crystals according to my invention having a mean silver iodide host crystal diameter of 0.2 micron and an epitaxial silver chloride diameter of 0.08 micron is imagewise exposed and processed so that only the epitaxial silver chloride grains are developed, I achieve a photographic speed which is even faster than that which is attainable with a silver chloride emulsion having a mean grain diameter of 0.2 micron, but I retain the more desirable graininess and granularity characteristics of an emulsion having a mean grain diameter of 0.08 micron. This result is not possible with a core-shell emulsion having a chloride shell.

Unless specifically modified during formation, the epitaxial chloride crystal renders the composite silver chloride and silver iodide crystal responsive to surface development. That is, a radiation-exposed composite silver halide crystal bearing a latent image can be developed in a surface developer. A surface developer is one which is substantially free of a soluble iodide salt or a silver halide solvent and is therefore only capable of initiating development of a latent image which lies at the surface of a silver halide grain. By contrast, an internal developer is a developer containing a silver halide solvent or soluble iodide salt or otherwise modified to permit access to the interior of a silver halide grain.

I specifically contemplate that the composite crystals of silver iodide and silver chloride can also be structurally formed so that latent images produced on exposure lie predominantly within the crystal structure rather than at its surface. Such composite crystals can be developed with an internal developer—that is, a developer containing iodide ions or a silver halide solvent, such as a thiocyanate or thioether. To predispose the composite crystals to form an internal latent image I can incorporate within the epitaxial silver chloride crystal an internal dopant for this purpose. Such dopants have been extensively employed in the art in preparing silver halide grains capable of forming direct positive (or direct reversal) photographic images. A variety of internal dopants have been disclosed in the art for permitting the formation of internal latent images, including metallic silver and compounds of sulfur, iridium, gold, platinum, osmium, rhodium, tellurium, selenium, etc.

In one preferred form in which the composite crystals form an internal latent image predominantly, the epitaxial silver chloride crystals are formed in the presence of foreign (non-silver) metal ions and preferably polyvalent metal ions. Generally, when the grains are formed in an aqueous medium, the epitaxial silver chloride crystals are formed in the presence of the water-soluble salts of the respective metal, preferably in an acidic medium. Typical useful polyvalent metal ions include divalent metal ions such as lead ions, trivalent metal ions such as antimony, bismuth, arsenic, gold, iridium, rhodium and the like and tetravalent metal ions such as platinum, osmium, iridium and the like. In highly preferred embodiments, the epitaxial silver chloride grains are formed in the presence of bismuth, lead or iridium ions. Generally, the epitaxial silver chloride crystals contain at least $10^{-9}$ and preferably at least $10^{-6}$ mole percent dopant based on the epitaxial silver chloride. The dopants are generally present in the epitaxial silver chloride grain in a concentration of less than about $10^{-1}$ and preferably $10^{-4}$ moles per mole of epitaxial silver chloride.

The composite silver chloride and silver iodide grains can be the sole silver halide grains present in an emulsion according to my invention. The composite grains can either be monodispersed or polydispersed. The term "monodispersed" is employed herein as defined in Illingsworth U.S. Pat. No. 3,501,305, issued Mar. 17, 1970. Namely, in order to be considered monodispersed, at least 95% by weight or by number of the composite silver halide grains must be within 40% of the mean diameter of the silver halide grains. The mean diameter is the average minimum diameter of the composite crystals. In FIG. 3, for example, this is the diameter measured along the fused bases of the truncated bipyramids forming the iodide crystal. The relative advantages of monodispersed and polydispersed emulsions are generally well understood in the art. For example, monodispersed emulsions exhibit higher contrast than corresponding polydispersed emulsions.

A preferred technique for forming the composite silver chloride and silver iodide crystals is to form first the host silver iodide crystals, employing any conventional silver iodide emulsion forming technique. To a reaction vessel containing the silver iodide emulsion a chloride ion containing feedstock, such as an alkali chloride salt solution, e.g. in sodium or potassium chloride salt solution, and a silver ion containing feedstock, such as a silver nitrate solution, are separately added. The silver and chloride ion feedstocks can be of any conventional type employed in double jet silver chloride preparations. The necessary vehicle for emulsion formation is at least in part already in the reaction vessel dispersing the silver iodide crystals. Additional vehicle can be introduced along with either or both of the silver ion or chloride ion feedstocks or using a separate jet. An internal dopant as described above can be incorporated in any of the above feedstocks or in the reaction vessel, if desired. The proportion of silver chloride in the final emulsion is determined by limiting the quantity of the silver and/or chloride ion introduced.

The techniques and parameters are well known in the art for favoring continued silver halide growth on an existing silver halide crystal, in this instance epitaxial deposition of silver chloride on the host silver iodide crystals, as compared with formation of new crystals. I have found that substantially all of the silver iodide host crystals can be converted to composite silver halide crystals, with little, if any, separate silver chloride crystal formation occurring, by employing a double jet precipitation of silver chloride as described above and rapid introduction of silver and chloride ions. With reduced silver and chloride ion feed rates and/or lower silver iodide crystal concentrations, a mixture of composite silver halide crystals, silver iodide crystals and silver chloride crystals can result. Where the composite silver halide crysrals are formed along with separate silver iodide and silver chloride crystals, conventional silver halide grain separation techniques can be employed to increase the proportion of the composite silver halide grains present. Alternatively, for many applications the emulsions can be employed directly as formed, as discussed below. While the composite silver halide grain preparation technique described above is preferred, othe techniques are known to produce composite silver halide crystal structures and can be employed, if desired.

It is recognized in the art that silver halide emulsions can be tailored to achieve desired photographic properties by blending dissimilar emulsions. For example, exact control over speed and contrast to achieve a desired target is frequently obtained by this technique. I specifically contemplate the composite silver halide grains as above described can be combined with conventional silver halide grains in a blended silver halide emulsion. Any proportion of the composite silver halide grains can be usefully present in the blended emulsion which will produce an observable effect on photographic response. Where the composite silver halide grains are being relied upon primarily for imaging rather than the other silver halide grains blended there-with, I perfer that at least 50% by weight of the silver halide grains present be composite silver halide grains.

I specifically contemplate the convenient formation or blending of silver chloride grains with the composite silver halide grains according to my invention. A distinct advantage which can be obtained by blending silver chloride grains with the composite grains, in addition to those generally associated with blending, is that the speed and/or silver image density can be materially enhanced due to physical development of the silver chloride grains, even though these grains may not be directly or chemically developable under the contemplated conditions of exposure or processing. While widely varied proportions of composite silver halide grains and silver chloride grains can be usefully employed, depending uon the specific end use contemplated, to achieve distinct advantages through solution physical development I perfer to blend into the emulsion at least about 1 percent by weight silver chloride grains, preferably about 5 percent, but less than about 50 percent, based on total silver halide present in the emulsion. Physical development of silver halide emulsions is discussed by Mees and James, cited above, Chapter 15, "The Mechanism of Development".

The photographic emulsions described in the practice of this invention can contain various colloids alone or in combination as vehicles and binding agents. Suitable hydrophilic materials include both naturally occurring substances such as proteins, for example, gelatin, gelatin derivatives, cellulose derivatives, polysaccharides such as dextran, gum arabic and the like; and synthetic polymeric substances such as all water-soluble polyvinyl compounds like poly(vinylpyrrolidone), acrylamide polymers and the like.

The described photographic emulsions employed in the practice of this invention can also contain, alone or in combination with hydrophilic, water-permeable colloids, other synthetic polymeric compounds such as dispersed vinyl compounds such as in latex form and particularly those which increase the dimensional stability of the photographic materials. Suitable synthetic polymers include those described, for example in U.S. Pat. Nos. 3,142,568 by Nottorf issued July 28, 1964; 3,193,386 by White issued July 6, 1965; 3,062,674 by Houck et al. issued Nov. 6, 1962; 3,220,844 by Houck et al. issued Nov. 30, 1965; 3,287,289 by Ream et al. issued Nov. 22, 1966; and 3,411,911 by Dykstra issued Nov. 19, 1968; particularly effective are those water-insoluble polymers or latex copolymers of alkyl acrylates and methacrylates, acrylic acid, sulfoalkyl acrylates or methacrylates, those which have cross-linking sites which facilitate hardening or curing, those having recurring sulfobetaine units as described in Canadian Pat. No. 774,054 by Dykstra and those described in U.S. Pat. No. 3,488,708 by Smith issued Jan. 6, 1970. Conventional proportions of vhicles and binding agents in the emulsions are contemplated.

In addition to the composite silver chloride and silver iodide crystals and the vehicle, the emulsions according to my invention can contain a variety of conventional components, depending upon the desired photographic application intended. Typically, the silver halide emulsions according to my invention are coated onto a photographic support to form one or more layers of a photographic element.

*Product Licensing Index,* Vol. 92, Dec. 1971, publication 9232, here incorporated by reference, discloses various forms which the silver halide emulsions and the photographic elements in which they are employed can take, as well as techniques for their formation. Emulsion washing can be undertaken, as described in paragraph II; development modifiers can be incorporated, as described in paragraph IV; antifoggants and stabilizers can be incorporated, as described in paragraph V; developing agents can be incorporated, as described in paragraph VI; hardeners can be incorporated, as described in paragraph VII; antistatic layers can be incorporated, as described in paragraph IX; photographic supports can be employed, as described in paragraph X; plasticizers and lubricants can be employed, as described in paragraph XI; coating aids can be employed, as described in paragraph XII; brighteners can be employed, as described in paragraph XIV; spectral sensitization can be employed, as described in paragraph XV; and absorbing and filter dyes can be employed, as described in paragraph XVI; each noted paragraph forming part of the above-cited *Product Licensing Index* publication.

The photographic emulsions according to my invention are suited for use in forming photographic elements responsive to visible light, including cinematographic elements, radiographic elements which are exposed to X-rays through one or more intensifying screens, color photographic elements, black-and-white photographic elements, image-transfer photographic elements, high contrast photographic elements and the like.

The silver halide emulsions employed in the practice of invention can be chemically sensitized according to procedures well known to those skilled in the art. For example, the silver halide emulsions can be sensitized with chemical sensitizers, such as with reducing compounds; sulfur, selenium or tellurium compounds; gold, platinum or palladium compounds; or combinations of these. Procedures for chemically sensitizing silver halide emulsions are described in Sheppard et al. U.S. Pat. No. 1,623,499 issued Apr. 5, 1927; Waller et al. U.S. Pat. No. 2,399,083 issued Apr. 23, 1946; McVeigh U.S. Pat. No. 3,297,447 issued Jan. 10, 1967 and Dunn U.S. Pat. No. 3,297,446 issued Jan. 10, 1967.

The composite silver halide grains can, specifically be chemically sensitized either during or after formation. For example, in the above described technique for forming the composite silver halide crystals, the compounds for chemical sensitiziation can be placed in the reaction vessel along with the silver iodide emulsion. Then, upon running in salts to form the epitaxial silver chloride crystals, concurrent chemical sensitization can occur.

The photographic elements according to my invention can be physically developed by conventional techniques. For example, physical development as disclosed by Agfa British Pat. No. 920,277, published Mar. 6, 1963; British Pat. No. 1,131,238, published Oct. 23, 1968 and Belgian Pat. No. 718,019, granted Jan. 13, 1969, is contemplated.

The photographic emulsions of this invention can be employed in conventional image transfer systems, if desired. Such systems are known to those skilled in the art. Colloid transfer systems are described in Yutzy et al. U.S. Pat. No. 2,596,756 issued May 13, 1952 and 2,716,059 issued Aug. 23, 1953. Silver salt diffusion transfer systems are described in Rott U.S. Pat. No. 2,352,014 issued June 20, 1944; Land U.S. Pat. No. 2,543,181 issued Feb. 27, 1951; Yackel et al. U.S. Pat. No. 3,020,155 issued Feb. 6, 1962 and Land U.S. Pat. No. 2,861,885, issued Nov. 25, 1958. Imbibition transfer systems are described in Minsk U.S. Pat. No. 2,882,156 issued Apr. 14, 1959. Color image transfer systems are described in Rogers U.S. Pat. Nos. 3,087,818 issued Apr. 30, 1963, 3,185,467 issued May 25, 1965, and 2,983,606 issued May 9, 1961; Weyerts et al. U.S. Pat. No. 3,253,915 issued May 31, 1966; Whitmore et al. U.S. Pat. No. 3,227,550 issued Jan. 4, 1966; Barr et al. U.S. Pat. No. 3,227,551 issued Jan. 4, 1966; Whitmore et al. U.S. Pat. No. 3,227,552, issued Jan. 4, 1966; Land U.S. Pat. Nos. 3,415,664, 3,415,645 and 3,415,646, all issued Dec. 10, 1968; Rogers U.S. Pat. Nos. 3,594,164 and 3,594,165 issued July 20, 1971; and Belgian Pat. Nos. 757,959 and 757,960 granted Apr. 23, 1971. Each of the image-transfer systems include an image-receiving means which receives and records at least a portion of each of the images formed in the photographic emulsion layer formed according to this invention.

Although specific modes of processing are elsewhere decribed, it is recognized that the photographic elements of this invention can be generally processed according to procedures well known to those skilled in the art. For example, conventional processing, such as disclosed in *Product Licensing Index,* cited above, paragraph XIII, is contemplaed for use with my photographic elements.

I have specifically discovered that it is possible to control whether the epitaxial chloride crystals or both the epitaxial chloride crystals and host silver iodide crystals in my emulsions are developed merely by controlling the choice of developing agents and the conditions of development. With vigorous developing agents, such as hydroquinone, catechol, halohydroquinones, mixtures of p-N-methylaminophenol sulfate (Elon) and hydroquinone, or 1-phenyl-3-pyrazolidinone (Phenidone), complete development of the composite silver halide crystals can be obtained. Similarly, if color developing agents, such as aminophenols and p-phenylenediamines, are employed in combination with color couplers substantially complete development of the composite silver halide crystals can be obtained. On the other hand, if color developing agents, i.e. the aminophenols or p-phenylenediamines, are employed for development in the absence of couplers, the epitaxial silver halide crystals can be selectively developed. This is because development begins with the silver chloride. With relatively slow development rates and without agitation, development can be terminated after silver chloride development is substantially completed and before significant silver iodide development has commenced. Thus, development can be specifically optimized for maximum silver development or for reduced graininess and granularity. The quantity of iodide ions released on development can also be controlled.

The emulsions of my invention are fully suitable for use in redox amplification systems such as those which require a heterogeneous catalyst to permit the reaction of an oxidizing agent and a reducing agent. In such systems the developing agent reduces the silver halide to produce a silver image which can act as a heterogeneous catalyst. Typical oxidizing agents include transition metal complexes, such as cobalt(III) complexes, and peroxide oxidizing agents—e.g. cobalt hexammine and hydrogen peroxide. The reducling agents for color developing agents which upon oxidation react with color couplers to produce dye images or electron transfer agents which upon oxidation react with redox dye releasers to release dye imagewise. If silver halide development and the redox amplification reactions employing the developing silver as a catalyst surface occur simultaneously in a single processing solution, the epitaxial silver chloride crystals can be developed to silver catalyst without iodide ion poisoning of the catalyst surface. If, however, the redox amplification reaction is carried out in a separate processing bath subsequent to development of the composite silver halide, the catalytic silver is poisoned by iodide released during silver iodide development and no redox amplification occurs. With these stated qualifications, the silver halide emulsions can be generally applied to conventional redox amplification processes. The silver halide emulsions can be substituted, for example, for those disclosed in Matejec U.S. Pat. No. 3,674,490, issued July 4, 1972; Travis U.S. Pat. No. 3,765,991, issued Oct. 16, 1973; Dunn et al. U.S. Pat. No. 3,822,129, issued July 2, 1974; Bissonette et al. U.S. Pat. No. 3,847,619, issued Nov. 12, 1974; Bissonette U.S. Pat. No. 3,834,907, issued Sept. 10, 1974; Bissonette U.S. Pat. No. 3,902,905, issued Sept. 2, 1975; Mowrey U.S. Pat. No. 3,904,413, issued Sept. 9, 1975; and Bissonette U.S. Pat. No. 3,923,511, issued Dec. 2, 1975; the disclosures of which are here incorporated by reference.

Because of their iodide content the emulsions and elements of my invention can be employed in redox amplification systems in which a heterogeneous catalyst is poisoned in an imagewise manner. A redox amplification system capable of forming reversal images which utilizes iodide ions to imagewise poison developed silver is disclosed in *Research Disclosure,* Vol. 148, Item 14836, published Aug. 1976. The composite silver halide crystals can be employed in the emulsions therein disclosed in lieu of the conventional silver haloiodide grains.

I specifically contemplate the use of the composite silver halide crystals in lieu of conventional silver halide grains in photographic elements which are heat processed—i.e., photothermographic elements. The composite silver halide crystals can be incorporated in conventional photothermographic elements, such as those described in Morgan et al. U.S. Pat. No. 3,547,075, issued July 22, 1969; Shepard et al. U.S. Pat. No. 3,152,904, issued Oct. 13, 1964; Yutzy and Yackel U.S. Pat. No. 3,392,020, issued July 9, 1968; Sullivan et al. U.S. Pat. No. 3,785,830, issued Jan. 15, 1974 and Sutton et al. U.S. Pat. No. 3,893,860, issued July 8, 1975.

Further, although I have described my composite crystals for use in silver halide emulsions, they can be employed in lieu of conventional silver halide crystals in any conventional silver halide photographic element.

The following examples are intended to further illustrate my invention:

EXAMPLE 1

A monodispersed silver iodide emulsion was prepared using the three solutions as set forth below in Table I.

TABLE 1

| Solution A | |
|---|---|
| Deionized bone gelatin | 100.0 g |
| Distilled water | 3.0 l |
| Temperature | 35° C |
| pH | 6.0 |
| Solution B | Solution C |
| 5 molar soln. of NaI, 820 ml | 5 molar soln. of $AgNO_3$, 800 ml |

The pAg of Solution A was adjusted to the halide ion side of the equivalence point by maintaining a −167 millivolt reading on a potentiometer connected to a silver electrode immersed in Solution A and a reference Ag/AgCl electrode at 25° C electrolytically connected through a diluted $KNO_3$ salt bridge to Solution A. Unless otherwise indicated, all millivolt potentials hereinafter reported were measured in a similar manner. Solution A was maintained at the indicated potential throughout silver halide precipitation. While Solution A was being stirred at 3900 rpm, Solutions B and C were each added simultaneously at an initial flow rate of 0.5 ml per minute. After 6 minutes the flow rate of each was accelerated over a period of 40 minutes to 3.6 ml per minute, with that flow rate being continued until Solution C was depleted. The total precipitation time was 197 minutes. Upon completion of the precipitation step Solution D (100 grams of phthalated gelatin in 3.0 liters of distilled water) was added to the emulsion and the pH was adjusted to 3.1 while maintaining the emulsion at 35° C. After coagulation, the supernatant liquid was decanted, 3.0 liters of distilled water were added and the pH was adjusted to 6.0 to get redispersion of the emulsion with stirring. The pH was again adjusted to 3.1 causing coagulation, supernatant liquid decanted, water added and pH adjusted, as indicated above. Then the procedure was again repeated. Finally, the pH of the emulsion was adjusted to 5.2. The silver iodide grains of the emulsion exhibited a mean diameter of 0.26 micron. The silver iodide grains were monodispersed hexagonal bipyramids. This emulsion is hereinafter referred to as ICE-1.

To form composite grains of silver iodide and silver chloride four additional solutions were prepared as set forth in Table II.

TABLE II

| Solution E | | Solution F | |
|---|---|---|---|
| ICE-1 306.9 g (0.19 mole silver) | | KCL | 4.36 g |
| | | Distilled Water | 40.0 g |
| Temperature 35° C pH 5.2 | | | |
| Solution G | | Solution H | |
| $AgNO_3$ | 8.27 g | phthalated gelatin | 10 g |
| Distilled Water | 35.0 g | | |

Solution E was stirred at 3750 rpm while Solutions F and G were added simultaneously at a rate of 20 ml per minute over a period of 2 minutes. Solution E was maintained at +180 millivolts by adjusting the flow rate of Solution F. Solution H was then added, and the emulsion was held for 10 minutes before adjustment to pH 3.5. The resulting coagulum was washed with 500 ml of distilled water; the supernatant liquid was decanted; and fresh distilled water and additional deionized bone gelatin were added to give an emulsion weighing 1.58 kilogram per mole of silver. The pAg and pH of the emulsion were adjusted to 7.9 and 5.0, respectively. The resulting emulsion contained 20 mole percent silver chloride based on total silver halide. Photomicrographs revealed silver halide grains similar to those shown in FIGS. 3 and 4. No separate silver chloride grains were visible. This emulsion is hereinafter referred to as JEM-4.

EXAMPLE 2

The emulsion (JEM-4) described in Example 1 above was chemically sensitized as follows: JEM-4 (4.11 g, 0.798 kg per mole Ag) was combined with an aqueous solution (15.9 g, 37% by wt) of deionized bone gelatin and the pAg was adjusted to 8.0 with KCl. A gold sulfide dispersion (1.21 g, 250 mg per mole Ag) was added to the emulsion; the emulsion was stirred for 45 min. at 40° C, combined with an aqueous solution (80 g, 3.7% by wt) of deionized bone gelatin, adjusted to pAg 7.5 and cooled. This chemically sensitized emulsion is referred to as JEM-6.

EXAMPLE 3

The emulsion described in Example 1 (JEM-4) was spectrally sensitized by adding 0.6 millimole Dye I per mole Ag to the emulsion, mixing thoroughly and coating on a suitable film support at 0.54 g Ag/m², 3.58 g gelatin/m², pAg 7.5 and pH 5.7.

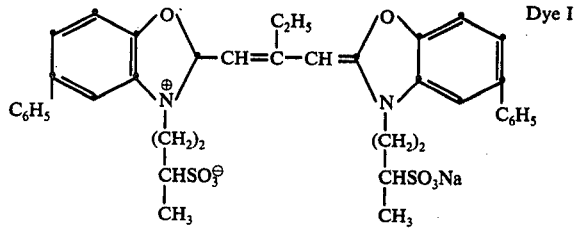

The spectrally sensitized emulsion was compared to the non-spectrally sensitized emulsion coated at the same coverage by exposing the coatings for 1 second through a wedge spectrograph (380 nm to 700 nm) and developing for 20 minutes at 20° C in Eastman Kodak D-19 developer. The results were as follows:

TABLE III

| Emulsion | Spectrally Sensitized | Peak Spectral Response |
|---|---|---|
| JEM-4 | No | 420 nm |
| JEM-4 | Yes | 420 nm + 546 nm |

The native spectral response of the emulsion corresponded to that of silver iodide, which exhibits an absorption peak at 420. Silver chloride, of course, exhibits only toe absorption in the visible spectrum.

EXAMPLE 4

This example illustrates the preparation of a composite epitaxial emulsion comprising 75 mole percent silver chloride based on total silver halide.

A silver iodide emulsion ICE-2 similar to ICE-1 was prepared as described in Example 1, except that the precipitation was terminated earlier to produce a monodispersed silver iodide grain population having a mean grain diameter of 0.1 micron.

To prepare the composite silver chloride and silver iodide grains three solutions were prepared as set forth below in Table IV.

TABLE IV

| Solution I | Solution J | |
|---|---|---|
| ICE-2 450 g (0.26 mole silver) Temperature 40° C pH 5.5 | 5 molar soln. of NaCl | 163 ml |
| | Solution K | |
| | 5 molar soln. of $AgNO_3$ | 157.6 ml |

Solution I was stirred at the rate of 3450 rpm while being maintained at a temperature of 40° C. Solutions J and K were added simultaneously each at a rate of 10 ml per minute to Solution I. The potential of the emulsion being formed was maintained at +160 mv during precipitation by varying the flow rate of Solution J.

The resulting epitaxial composite emulsion was similar to that prepared in Example 1, except that the higher percentage of silver chloride caused the silver chloride crystals to be larger than those of silver iodide. The silver chloride crystals in most instances formed an epitaxial junction with truncating facets of the silver iodide crystals, and silver chloride crystal growth appeared to have overlapped a portion of the silver iodide crystal facets adjacent the truncating facet at which the junction was originally formed. In some instances two silver chloride crystals were observed epitaxially associated with a single silver iodide crystal. In no instance could a silver chloride crystal or crystals be seen to cover a majority of the facets of a single silver iodide crystal with which it was epitaxially associated.

EXAMPLE 5

This example illustrates the use of JEM-4 and the chemically sensitized counterpart emulsion JEM-6 in a redox amplification process.

Each of the emulsions was identically modified by the incorporation of cyan dye-forming coupler, 2[(2,4-di-tert-amylphenoxy)butyramido]-4,6-dichloro-5-methylphenol, in a blend of gelatin and coupler solvent, as is widely practiced in the art. The emulsions were each coated on a film support and exhibited the following characteristics: 0.54 gram silver per square meter, 3.58 grams gelatin per square meter, and 1.08 gram coupler per square meter. The pAg and pH of the coatings were 7.5 and 5.4, respectively. Both of the coatings were exposed for one-tenth second to tungsten light (500 watts, 3000° K) through a graduated neutral density stepwedge using an Eastman 1b Sensitometer. The coatings were then processed for 2 minutes in Developer A, the composition of which is set forth below in Table V.

TABLE V

| Developer A | |
|---|---|
| Distilled water | 900 ml |
| $K_2CO_3$ | 10 g |
| $K_2SO_3$ | 2 g |
| 4-Amino-N-ethyl-N-(2-methoxyethyl)-m-toluidine, para-toluene sulfonate | 5 g |
| Distilled water to | 1 liter |
| 30% by wt. aqeuous solution of hydrogen peroxide | 10 ml |

In both coatings significant dye image amplification was observed. In the coating prepared from JEM-4, which was not chemically sensitized, the contrast was 1.37, the minimum density 0.14 and the maximum red density was 1.80. In the coating prepared from JEM-6, which was chemically sensitized, the contrast was 1.47, the minimum density 0.16 and the maximum red density 1.86. Taking the relative speed of JEM-4 as 100, the coating prepared from JEM-6 exhibited a relative speed of 427. Speed was measured at 0.30 above minimum density.

EXAMPLE 6

This example illustrates the behavior of composite epitaxial silver chloride and silver iodide emulsions as compared to silver chloride emulsions, silver iodide emulsions and blended emulsions containing physically separate silver chloride and silver iodide grains.

The emulsions listed below were each coated on a film support with a gelatin coating density of 3.58 grams per square meter, a pAg of 7.5 and a pH of 5.7.

(a) ICE-1 — a silver iodide emulsion (see Example 1)
(b) CCE-1 — a silver chloride emulsion having monodispersed cubic grains 0.2 micron in mean diameter
(c) JEM-4 — a chemically unsensitized composite epitaxial emulsion (see Example 1)
(d) JEM-6 — a chemically sensitized composite epitaxial emulsion (see Example 2)
(e) ICE-1 + CCE-1
(f) JEM-4 + CCE-1

The coatings were exposed for ½ second to tungsten light (500 watts, 3000° K) using an Eastman Kodak 1B Sensitometer and processed for 20 minutes at 20° C in Kodak Developer D-19. The sensitometric results are summarized in Table VI below.

TABLE VI

| Coating | gAg/m² AgCl/AgI | gAg/m² Chem.Sens. AgCl/AgI | gAg/m² AgCl | gAg/m² AgI | Rel.* Speed | Silver Image Gamma | $D_{min}$ | $D_{max}$ |
|---|---|---|---|---|---|---|---|---|
| (a) ICE-1 | None | None | None | 0.54 | ** | ** | 0.03 | 0.08 |
| (b) CCE-1 | None | None | 0.54 | None | 6.2 | 0.77 | 0.03 | 0.41 |
| (c) JEM-4 | 0.54 | None | None | None | 100.0 | 0.28 | 0.03 | 0.50 |
| (d) JEM-6 | None | 0.54 | None | None | 436.0 | 0.28 | 0.03 | 0.54 |
| (e) ICE-1 + CCE-1 | None | None | 0.54 | 0.54 | ** | ** | 0.03 | 0.10 |
| (f) JEM-4 + CCE-1 | 0.54 | None | 0.54 | None | 100.0 | 0.36 | 0.03 | 0.58 |

*Measured at 0.10 above $D_{min}$
**Not measurable

Viewing the results as set forth in Table VI it can be seen that ICE-1 (the iodide control emulsion) is so photographically unresponsive as to exhibit no measurable speed or contrast. CCE-1 (the chloride control emulsion) is very slow in comparison with JEM-4, exhibits a higher contrast (gamma) and a lower maximum density. The chemically sensitized counterpart of emulsion JEM-4, JEM-6, increases the speed of the coating by 0.64 log E compared to the coating containing JEM-4, but other parameters are unaffected. Blending ICE-1 and CCE-1 produces an emulsion which does not differ significantly from ICE-1 alone in its photographic characteristics. Blending CCE-1 with JEM-4 does not increase speed and increases contrast and maximum density only a small amount.

EXAMPLE 7

This example essentially repeats Example 6, except that coatings were prepared and exposed as in Example 5. One variation in exposure was that exposure was for ½ second, rather than 1/10 second, as in Example 5. The coatings were photographically processed with 2 minute development times according to the general procedure described in the July 1974, *British Journal of Photography*, pp. 597–598.

The results are set forth in Table VII. It can be seen that ICE-1 was again so photographically unresponsive as to exhibit no measurable speed or contrast. CCE-1 was very slow in comparison to JEM-4, exhibited higher contrast, but lower maximum density. The blend of ICE-1 and CCE-1 produced a coating exhibiting a photographic speed which was higher than that of CCE-1 alone, but lower than JEM-4. This blended emulsion further exhibited a very low contrast and maximum density.

TABLE VII

| Coating | gAg/m² AgCl/AgI | gAg/m² Chem.Sens. AgCl/AgI | gAg/m² AgCl | gAg/m² AgI | Rel.* Speed | Cyan Dye Image Gamma | $D_{min}$ | $D_{max}$ |
|---|---|---|---|---|---|---|---|---|
| (a) ICE-1 | None | None | None | 0.54 | ** | ** | 0.05 | 0.05 |
| (b) CCE-1 | None | None | 0.54 | None | 4.8 | 3.83 | 0.05 | 0.68 |
| (c) JEM-4 | 0.54 | None | None | None | 100.0 | 1.36 | 0.05 | 1.26 |
| (d) JEM-6 | None | 0.54 | None | None | 1200.0 | 0.75 | 0.10 | 1.27 |
| (e) ICE-1 + CCE-1 | None | None | 0.54 | 0.54 | 18.5 | 0.28 | 0.05 | 0.38 |
| (f) JEM-4 + CCE-1 | 0.54 | None | 0.54 | None | 129.0 | 1.59 | 0.05 | 2.10 |

*Measured at 0.10 above $D_{min}$
**Not measurable

The blend of JEM-4 and CCE-1 produced an emulsion coating having a higher speed than the JEM-4 emulsion alone, a higher contrast and a much higher maximum density. This illustrates that distinct photographic advantages can be gained in color systems using a blend of the composite epitaxial silver chloride-silver iodide grains with silver chloride grains.

EXAMPLE 8

This example illustrates the enhancement in internal sensitivity which can be achieved through the use of an internal metal dopant in the epitaxial silver chloride grains.

Two emulsions JEM-8 and JEM-10 were identically prepared, except that the latter emulsion was prepared by precipitating silver chloride in the presence of 200 parts per million (based on silver chloride) of $K_3IrCl_6 \cdot 3H_2O$. The solutions employed for preparation are set forth below in Table VIII:

TABLE VIII

| Solution L | |
|---|---|
| ICE-1 (0.07 mole silver) | 102.3 g |
| Distilled water | 200.0 g |
| Deionized bone gelatin | 7.0 g |
| $K_3IrCl_6 \cdot 3H_2O$ | 7.5 mg* |
| Temperature | 35° C |
| pH | 5.2 |

*JEM-10 only

| Solution M | | Solution N | |
|---|---|---|---|
| KCl | 5.81 g | $AgNO_3$ | 11.02 g |
| Distilled Water | 120 ml | Distilled Water | 120 ml |

Solution L was stirred at 3750 rpm. Solutions M and N were added to Solution L at 20 ml per minute over a 6.3 minute addition period. The potential of Solution L and the solution resulting from additions thereto was maintained at +180 millivolts by varying the flow rate of Solution M. At the conclusion of the precipitation step, the emulsion was adjusted to 40° C, 5 grams of phthalated gelatin were added to the reaction vessel, and the mixture was adjusted to pAg 7.8, pH 3.5. The supernatant liquid was decanted and the coagulum was washed with distilled water. Additional bone gelatin was added and the final emulsion was adjusted to pAg 8.0, pH 5.0 (1.46 kg/mole Ag).

Each resulting emulsion consisted of silver chloride crystals of 0.1 micron mean diameter grown onto silver iodide grains of 0.26 micron mean diameter in an equal molar ratio. The composite epitaxial emulsion appeared monodispersed—that is, there was not a large variation in grain sizes. The emulsions were coated on a film support and exposed through a graduated density sensitometric stepwedge at 420 nm with a high intensity Xenon sensitometer.

Both samples were examined for surface sensitivity by processing them in the surface developer set forth in Table IX. A surface developer is one which is only capable of initiating imagewise development of silver halide grains bearing a surface latent image.

TABLE IX

| | |
|---|---|
| p-Methylaminophenol sulfate | 7.0 g |
| Ascorbic Acid | 5.0 g |
| KCl | 0.4 g |
| $Na_2HPO_4$ | 1.0 l |
| Distilled water to | 1.0 l |
| Adjust pH to | 7.5 |

Additional samples of each coating were exposed in the same manner and examined for internal sensitivity by bleaching the surface image in an aqueous solution of $K_4Fe(CN)_6$ for 5 minutes and then processing the bleached strip for 2 minutes in an internal developer like that described in Table IX, except that it contained 100 mg/l of potassium iodide in addition to the other components. An internal developer differs from a surface developer in that it is capable of imagewise developing silver halide grains having either internal or surface latent images. In the above procedure bleaching removed or at least substantially reduced the surface latent image present.

By having iridium present during the precipitation of the chloride phase of the epitaxial emulsion an increase in internal sensitivity at 420 nm of 0.60 log E was observed while surface sensitivity decreased by 0.40 log E. The internal spectral response of the iridium containing composite emulsion corresponded to that of silver iodide.

EXAMPLE 9

The purpose of this example is to illustrate the selective development of the silver chloride portion of a composite epitaxial emulsion according to the present invention.

A composite epitaxial emulsion of silver chloride and silver iodide was prepared by rapidly adding 10 ml of a $4.96 \times 10^{-2}$ Molar sodium chloride solution to a mixture consisting of 10 ml of a $5.79 \times 10^{-3}$ Molar silver nitrate solution and 1.0 ml of a silver iodide emulsion. The silver iodide emulsion exhibited a weight of 1.858 kilograms per mole of silver, a pH of 4.0 and a pAg of 7.0 before being diluted with an equal volume of distilled water. The mean grain diameter of the silver iodide emulsion was 0.2 micron. After standing at room temperature for 10 minutes, about 1 ml of a 12.5% aqueous solution of deionized gelatin having a temperature of 54° C was added with stirring to the room temperature silver halide emulsion.

The composite emulsion so prepared was further modified for coating onto a film support by the addition of still additional deionized gelatin, a photographic hardener (formaldehyde) and a wetting agent (octylphenoxypoly(ethoxy)ethanol, commercially available under the trademark Triton X-100). The coating composition was found to have a pH of 4.9 and a pAg of 7.7. It was coated on a film support at a wet thickness of 300 microns to give the approximate concentrations of components set forth in Table X. The components marked by asterisk are starting components which undergo chemical reactions prior to or during coating.

TABLE X

| | mg/dm$^2$ |
|---|---|
| Gelatin | 32.5 |
| AgI | 1.84 (as Ag) |
| $AgNO_3$* | 0.4 (as Ag) |
| NaCl* | 1.14 (as Cl) |
| Wetting Agent | 1.3 |
| Formaldehyde* | 0.3 |

Electron micrographs of an unprocessed sample of the above-described emulsion coating clearly showed the presence of small cubic silver chloride crystals on the surface of the larger predominantly truncated hexagonal bipyramid silver iodide crystals. Typical composite grains appeared similar to those of FIGS. 3 and 4.

The ability to develop selectively the silver chloride portion of the composite emulsion leaving the silver iodide portion, for the most part, undeveloped, was effectively illustrated by giving two portions of the above-described film sample maximum density exposures. The two samples were then each lowered into a different, nonagitated developer solution in intervals of 1 centimeter per minute for a total time period of 10 minutes. One portion was lowered into a Kodak D-19 black-and-white developer solution containing 0.1% polyethylene glycol, and the other was lowered into a color developer solution consisting essentially of 4-amino-N-ethyl-N-(2-methoxyethyl)-m-toluidine paratolenesulfonate as the sole developing agent. Both samples were then fixed in Kodak F-5 fixing solution for 5 minutes. The amount of developed silver was analyzed by X-ray fluorescence using 28 second counts and compared to the amount of silver analyzed to be in an undeveloped coating to determine the percentage of silver that had developed.

The results are set forth in FIG. 5. Curve A shows the amount of silver developed with the black-and-white developer solution. Curve B shows the amount of silver developed using the color developer solution. Curve C is a reference line indicating the percent of total silver present in the form of silver chloride. From these curves it can be seen that the black-and-white developer solution developed both the silver chloride and the silver iodide present in the composite emulsion. On the other hand, the color developer solution selectively developed the silver chloride without appreciable development of silver iodide. Thus, selective development of silver chloride present in the composite emulsion is feasible.

The term "epitaxial" as applied to the composite silver chloride-silver iodide crystals or grains is employed in its accepted usage to means that the crystallographic orientation of the silver and chloride atoms of the crystals are controlled by the crystalline substrate, the silver iodide crystals, on which they are grown. The epitaxial relationship of the silver chloride and silver iodide portions of the composite crystals is then quite distinct from direct physical contact of separate silver iodide and silver chloride crystals, even if emulsion peptizer did not interfere.

*Product Licensing Index* and *Research Disclosure,* both cited above, are published by and available from Industrial Opportunities Ltd., Homewell, Havant Hampshire, PO9 1EF, United Kingdom.

The invention has been described with particular reference to preferred embodiments thereof but it will be understood that variations and modifications can be effected within the spirit and scope of the inventions.

I claim:

1. A photographic emulsion comprised of a photographic vehicle as a continuous phase and, as a discrete phase, radiation-sensitive composite silver halide crystals comprised of multi-faceted, radiation-receptive silver iodide crystals having a minimum mean diameter of at least 0.1 micron, silver chloride crystals forming epitaxial junctions with the silver iodide crystals, at least half of the facets of the silver iodide crystals being substantially free of epitaxial silver chloride, and silver chloride being limited to less than 75 mole percent, based on the total silver halide forming said composite crystals.

2. An emulsion according to claim 1 wherein the silver iodide is predominantly beta-phase silver iodide present in the form of truncated bipyramid crystals.

3. An emulsion according to claim 1 wherein the silver iodide crystals have a minimum mean diameter of at least 0.2 micron.

4. An emulsion according to claim 1 wherein the silver halide crystals are monodispersed.

5. An emulsion according to claim 4 wherein 95% by weight or by number of the composite silver halide crystals are within 40% of their mean diameter.

6. An emulsion according to claim 1 wherein at least 1% on a mole basis of the total composite silver halide crystals present is silver chloride.

7. An emulsion according to claim 6 wherein at least 5% on a mole basis of the total composite silver halide crystals present is silver chloride.

8. An emulsion according to claim 1 wherein less than 50% on a mole basis of the total composite silver halide crystals present is silver chloride.

9. An emulsion according to claim 1 wherein the silver chloride crystals are predominantly internal latent image forming silver chloride crystals.

10. An emulsion according to claim 1 wherein the silver chloride crystals contain an internal dopant to promote the formation of an internal latent image upon exposure.

11. An emulsion according to claim 1 wherein from 1 to 50% on a mole basis of the total silver halide present is in the form of separate silver chloride crystals blended among the composite silver halide crystals.

12. An emulsion according to claim 11 wherein at least 5% on a mole basis of the silver halide is in the form of separate silver chloride crystals blended among the composite silver halide crystals.

13. An emulsion according to claim 11 wherein a dye-forming coupler is additionally present in the emulsion.

14. A photographic gelatino-silver halide emulsion incorporating as a discrete phase, monodispersed radiation-sensitive composite silver halide crystals comprised of beta-phase truncated bipyramid silver iodide crystals having a minimum mean diameter of at least about 0.2 micron, in each composite crystal at least one silver chloride crystal forming an epitaxial junction with the silver iodide crystal, at least half of the facets of the silver iodide crystal being substantially free of epitaxial silver chloride and silver chloride being limited to from 1 to less than 50 mole percent, based on the total silver halide forming the composite silver halide crystals.

15. In a photographic element comprised of a support and, as a coating on the support, a radiation-sensitive emulsion layer including a photographic vehicle as a continuous phase and, as a discrete phase, radiation-sensitive silver halide crystals, the improvement wherein at least a portion of the radiation-sensitive silver halide crystals are composite silver halide crystals comprised of multi-faceted, radiation-receptive silver iodide crystals having a minimum mean diameter of at least 0.1 micron, silver chloride crystals forming epitaxial junctions with the silver iodide crystals, at least half of the facets of the silver iodide crystal being substantially free of epitaxial silver chloride, and silver chloride being limited to less than 75 mole percent, based on the total silver halide forming the composite crystal.

16. In a photographic element according to claim 15, the further improvement wherein the silver iodide is predominantly beta-phase silver iodide present in the form of truncated bipyramid crystals and the silver iodide crystals are monodispersed and having a minimum mean diameter of at least 0.2 micron.

17. In a photographic element according to claim 15, the further improvement wherein the silver iodide crystals forming epitaxial junctions with the silver iodide crystals are present in a concentration of from 5 to less than 50 mole percent, based on the total composite silver halide crystals present.

18. In a photographic element according to claim 15, the further improvement wherein the silver crystals are internally doped with iridium.

19. In a photographic element according to claim 15, the further improvement in which the element contains a dye-forming color coupler and the silver halide emulsion contains in addition to composite silver halide crystals from 1 to less than 50 mole percent based on total silver halide of separate silver chloride crystals.

20. In a photographic element comprised of a support and, at least one radiation-sensitive gelatino-silver halide emulsion layer as a coating on the support, the improvement wherein the radiation-sensitive gelatino-silver halide emulsion layer contains monodispersed composite silver halide crystals consisting essentially of beta-phase truncated bipyramid silver iodide crystals having a minimum mean diameter of at least about 0.2 micron, in each composite crystal at least one silver chloride crystal forms an epitaxial junction with the silver iodide crystal, at least half of the facets of the silver iodide crystal are substantially free of epitaxial chloride and the silver chloride is limited to from 1 to less than 50 mole percent, based on the total silver halide forming the composite silver halide crystals.

* * * * *